United States Patent [19]

Cayot

[11] Patent Number: 4,831,991

[45] Date of Patent: May 23, 1989

[54] FUEL INJECTION PUMP

[75] Inventor: Jean-Francois Cayot, St Jean de Braye, France

[73] Assignee: Lucas Industries Public Limited Company, Birmingham, England

[21] Appl. No.: 898,911

[22] Filed: Aug. 21, 1986

[30] Foreign Application Priority Data

Aug. 21, 1985 [FR] France ..... 85 12579

[51] Int. Cl.[4] ..... F02M 39/00

[52] U.S. Cl. ..... 123/516; 123/506; 123/450

[58] Field of Search ..... 123/450, 198 D, 198 DB, 123/506, 516, 458; 417/462

[56] References Cited

U.S. PATENT DOCUMENTS

| | | | |
|---|---|---|---|
| 4,351,283 | 9/1982 | Ament | 123/506 |
| 4,377,139 | 3/1983 | Jarrett | 123/198 D |
| 4,393,844 | 7/1983 | Skinner | 123/450 |
| 4,509,480 | 4/1985 | Kull | 123/198 D |
| 4,515,125 | 5/1985 | Bulk | 123/198 D |
| 4,523,569 | 6/1985 | Seilly | 123/506 |
| 4,550,702 | 11/1985 | Djordjeuic | 123/506 |
| 4,562,815 | 1/1986 | Takano | 123/450 |
| 4,598,683 | 7/1986 | Ohmori | 123/450 |

FOREIGN PATENT DOCUMENTS

| | | | |
|---|---|---|---|
| 0085357 | 5/1983 | Japan | 123/516 |

*Primary Examiner*—Carl S. Miller

[57] ABSTRACT

A fuel injection pump of the rotary distributor type includes a pumping element movable in a bore to displace fuel from the bore to the injection nozzles of an engine in turn. A regulator controls the supply of fuel to the bore and is responsive to the speed of the engine and the setting of a control lever coupled to the accelerator pedal of a vehicle driven by the engine. The pump also includes valve means which is opened when the engine speed is above a predetermined value and the accelerator pedal has been released by the vehicle driver. The valve means when open prevents the supply of fuel to the engine and as the engine speed falls closes at a predetermined speed to restore the supply of fuel.

4 Claims, 5 Drawing Sheets

16
15
17
14
11
10
1
12
13
9
7
2
8
3
6
5
18
19
4

FUEL INJECTION PUMP

The invention relates to a rotary distributor type fuel injection pum for supplying fuel to an internal combustion engine, particularly a diesel engine.

Injection pumps of this type irrespective of the number of cylinders in the associated engine comprise a pumping element (or a group of several pumping elements) and a distributor rotor, which rotates in a fixed casing. A cam ring arranged around the rotor is provided with lobes on its internal peripheral surface. When the rotor is rotated the cam lobes engage a cam follower to cause inward movement of the pumping element to effect delivery of fuel to the associated engine.

Figure 1:
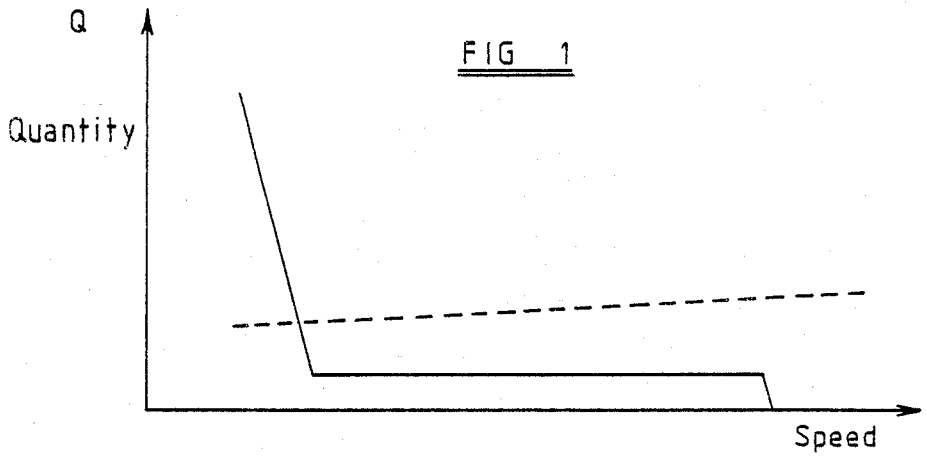

The injection pump is also provided with a device, called a regulator or governor, which regulates the volume of fuel delivered by the pump to the engine injectors, depending on the speed of rotation of the engine and the position of a control lever, with the latter being linked to the accelerator pedal of the vehicle. In order to improve the driving behaviour of the vehicle, these regulators are generally in the form of "maximum speed and deceleration regulators". An example of such a regulator is shown in French Pat. No. 7702918. It also allows the characteristic shown in solid in FIG. 1 to be obtained. This characteristic is based on the presence of a so-called "residual" flow of fuel in the deceleration stage. This residual flow reduces the shock or jolt, which is produced when braking the engine. The dotted characteristic in FIG. 1 shows the fuel delivery for engine idling.

Tests have shown that this residual flow of fuel may not burn properly in some engines, given that it is necessarily restricted to a small quantity. It has also been found that the emission of non-burned hydrocarbon pollutants and particles is adversely affectd by this low volume injection, particularly at medium and high engine speeds.

The most radical solution available in order to minimise the emission of pollutants is to completely stop this flow in the deceleration stage. Such a solution will, however, seriously affect the vehicle performance at low speeds in urban driving, given the abrupt appearance of a high engine braking force.

The invention has the object of providing an injection pump in which a residual flow in the deceleration stage at low speed is retained, combined with a total elimination of the injected flow at medium and high speeds.

To this effect, the injection pump according to this invention is provided with an internal electrical control device, such as an electromagnet, which controls a sealing element permanently linked to the pumping chamber. Depending on the condition of the current applied to the electrical device, the sealing element is either closed to allow injection or open to prevent injection.

Figure 1A:
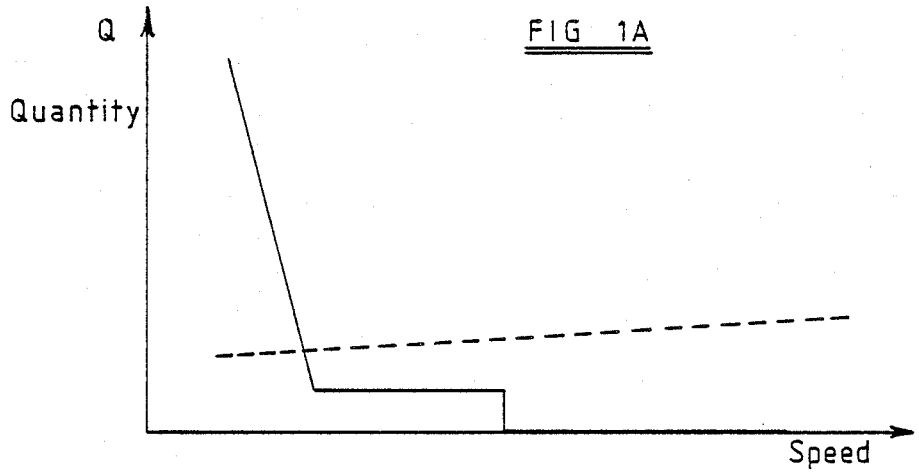
Figure 2:
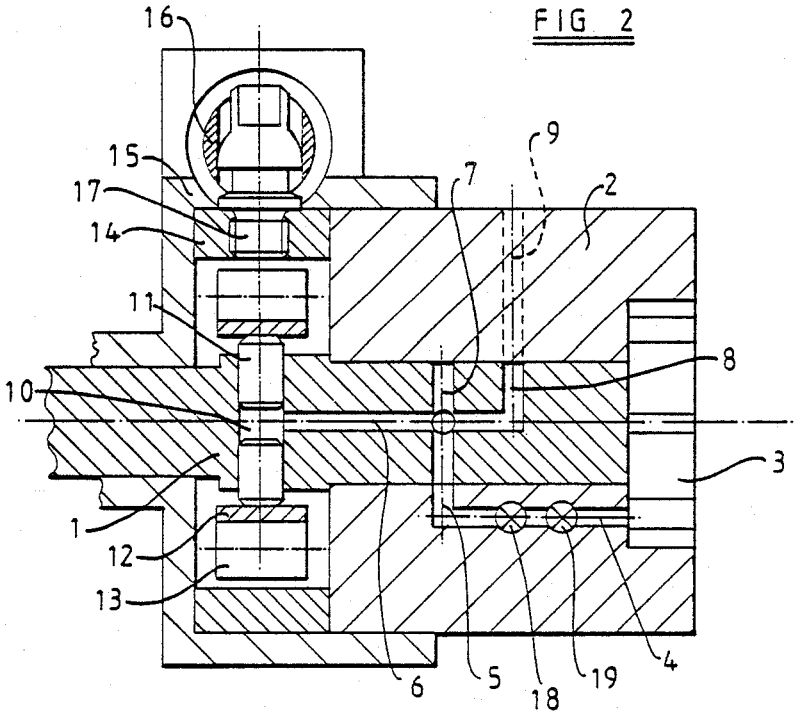
Figure 3:
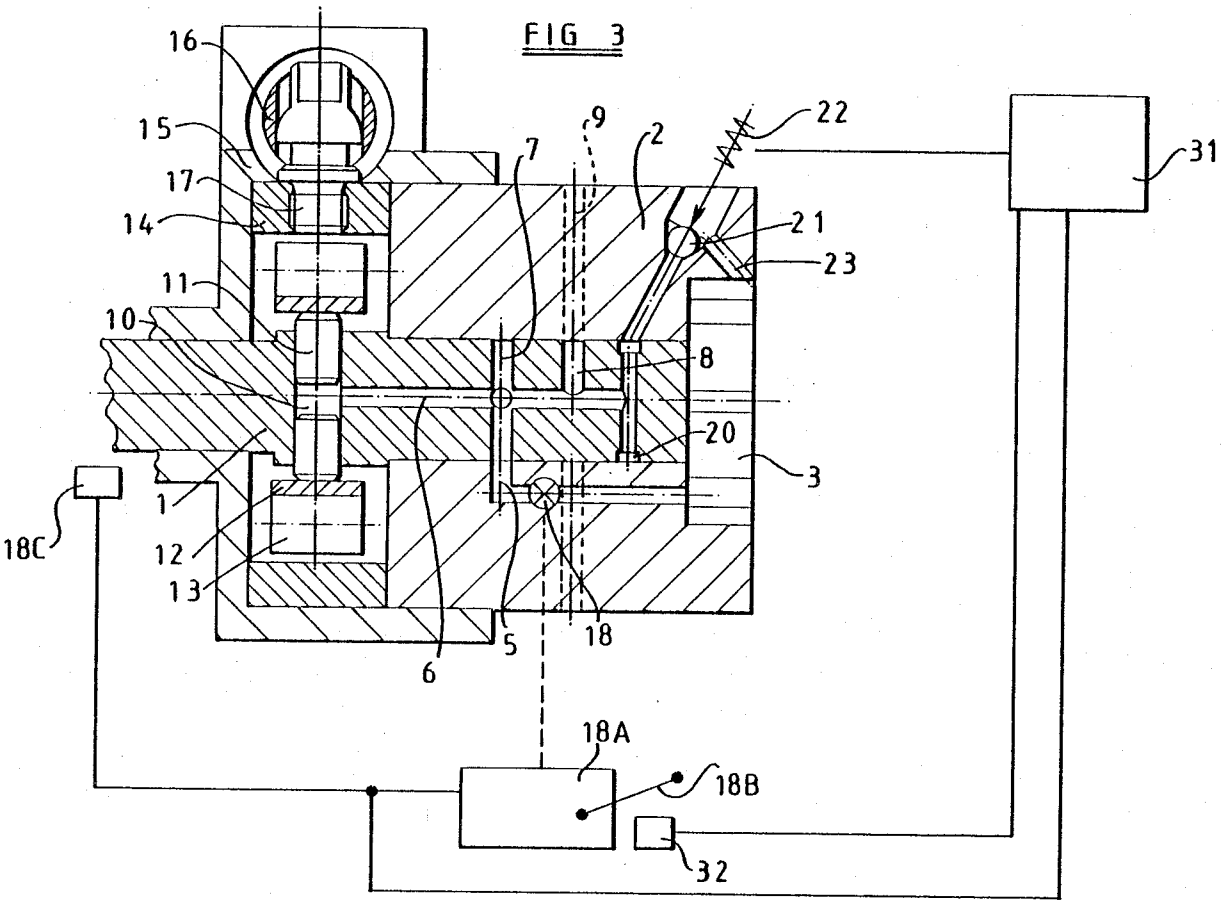
Figure 4:
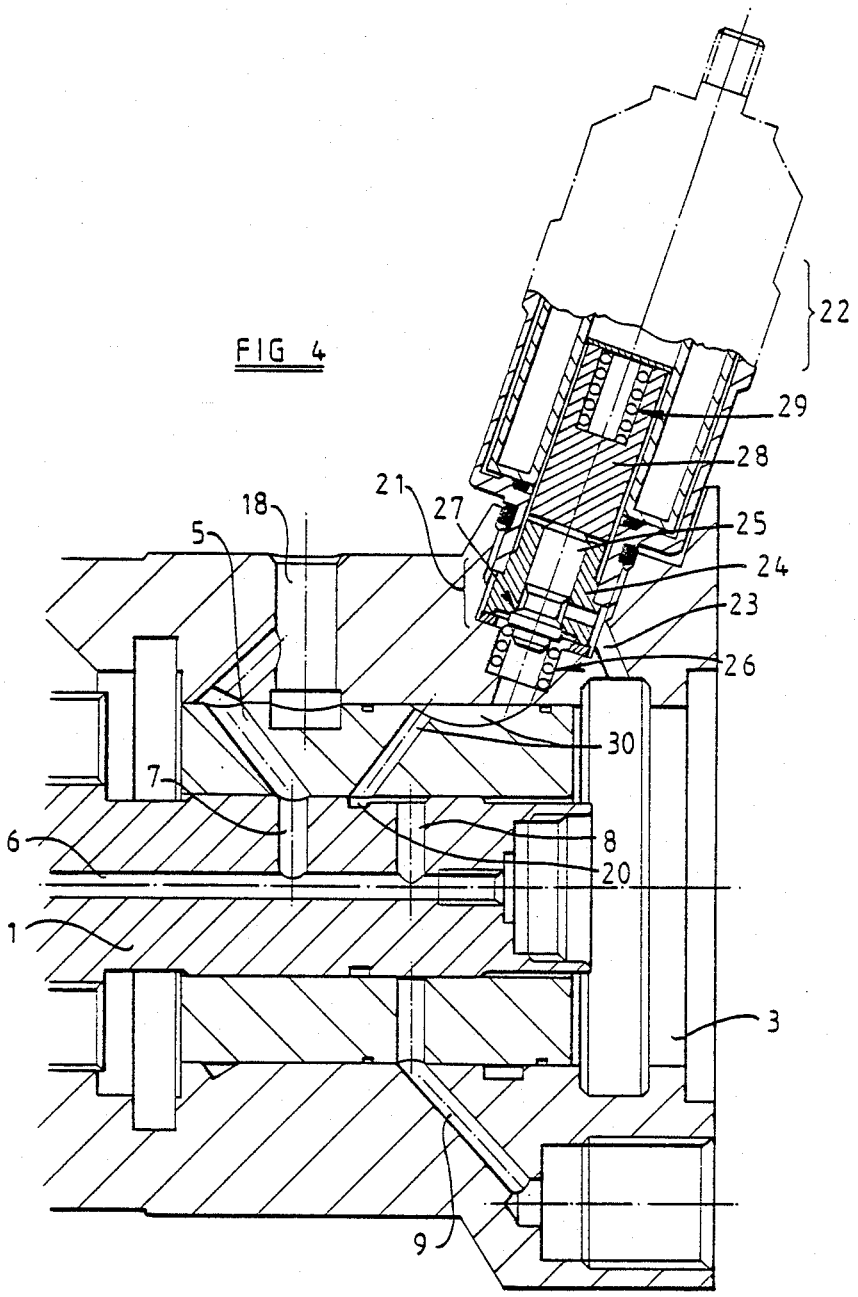

The invention is described in the following and in the accompanying drawings, in which:

FIGS. 1 and 1A show the fuel flow characteristics of a standard and modified pump respectively, FIG. 2 is a sectional view along the axis of a fuel injection pump and rotary distributor, FIG. 3 shows an injection pump equipped with the device according to the invention, and FIG. 4 shows, by way of example, a practical embodiment of a part of the pump seen in FIG. 3.

Figure 5A:
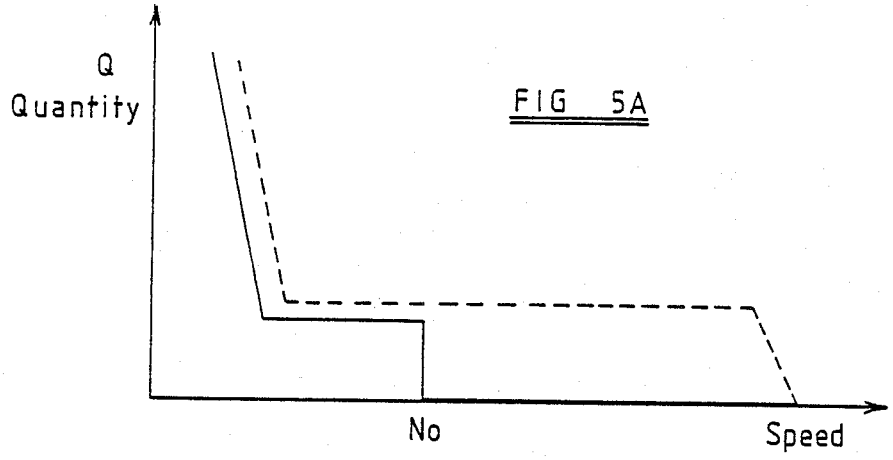
Figure 5B:
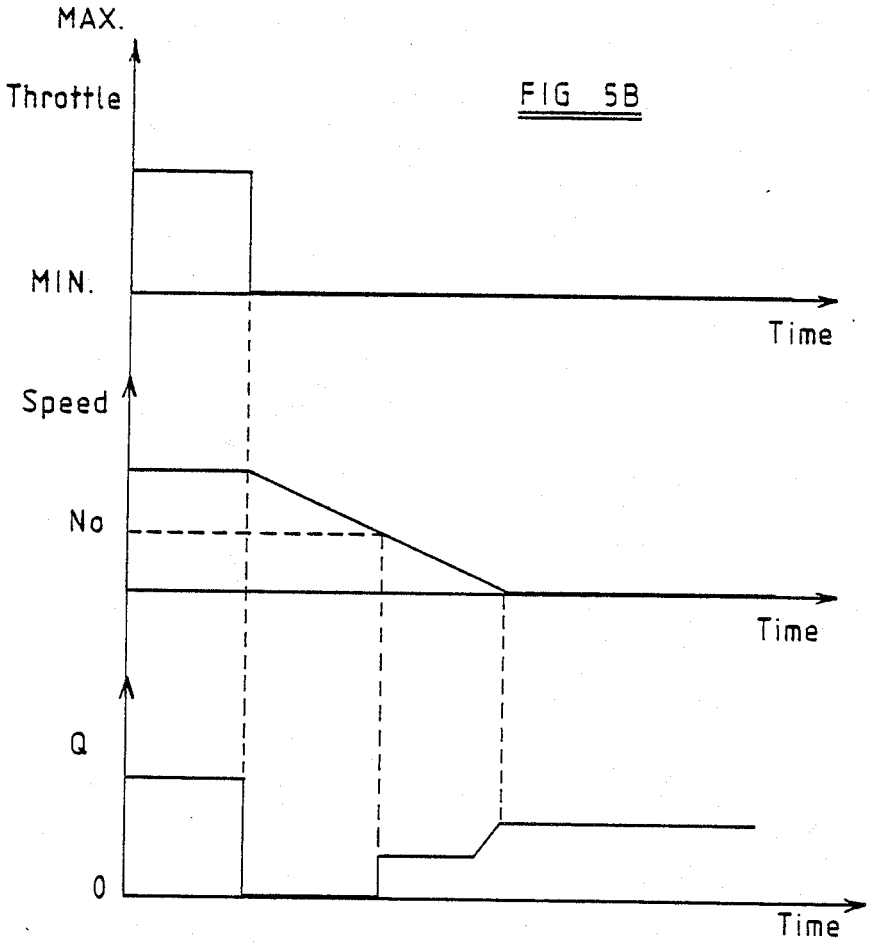

FIGS. 5A and 5B show pump quantity variations with speed and throttle, speed and quantity variations with time, respectively, In FIG. 2 there is shown a fuel injection pump comprising a rotor 1 fitted inside a fixed casing 2, with the rotor being driven in use in synchronisation with the engine to be supplied with fuel. The rotor 1 is connected at one end to the rotary section of a feed pump 3 whose outlet 4 communicates through a flow control device 18 with an inlet aperture 5, which opens onto the surface of the rotor. The outlet pressure of the feed pump 3 is controlled by a valve, not shown, so as to vary in accordance with the engine speed.

Rotor 1 is provided with an axial duct 6, which communicates with a number of inlet ducts 7 formed inside the rotor at equiangular positions and which register in turn with the inlet aperture 5 when the rotor is turning. The axial duct 6 is also linked to an outlet duct 8 which registers in turn with a number of outlets 9 when the rotor is turning. These outlets are formed in the fixed casing 2, with each being linked in use to an injector of the associated engine.

The end of the axial duct 6 is connected to a transverse bore 10 arranged inside the rotor and in which is located a pair of opposite pistons or elements 11, forming a pumping chamber.

The outer ends of the pistons 11 are in contact with cam followers formed by shoes 12 and rollers 13. A cam ring 14 surrounds the rotor and is provided with cam lobes around its internal circumference with which the rollers 13 engage when the rotor is turning, causing inward movement of pistons 11 and, thus, a flow of the fuel present in the pumping chamber in the direction of the outlet duct 8.

Between the outlet 4 of the feed pump and inlet duct 5, there is generally provided a stop device 19 which serves to prevent the supply of fuel. This device is generally in the form of an electromagnetic valve which is controlled by the ignition key of the vehicle.

FIG. 3 illustrates the modification according to the invention. The duct 6 is lengthened and, by means of a transverse bore is permanently connected to a groove 20, arranged at the circumference of rotor 1. This groove is linked to a sealing element 21 whose position is defined by an actuator 22. When the sealing element 21 is open, a duct 23 allows the pressure of fuel in duct 6 to be discharged into the low pressure side of the feed pump 3.

The flow control device 18 is controlled by a regulator 18A which includes a control lever 18B connected to the throttle pedal of the vehicle. The regulator can be of the type shown in the aforementioned French specification but for convenience it is shown to receive a speed signal from a transducer 18C.

FIG. 4 represents, by way of example, a practical embodiment of the pump, with the various references of the previous illustration being reproduced in this drawing. The figure shows groove 20 being permanently linked to the central duct 6, which is itself permanently linked to the pumping chamber 10 (not shown on this drawing). By means of duct 30, the pressure in duct 6 is taken to the underside of a sealing element 21. This sealing element comprises a fixed seat 24, a movable valve member 25 and a return spring 26. The sealing action is ensured by an oblique contact 27 between the valve member and the seat. Return spring 26 serves to return the valve to its seat in the sealed position. It should also be noted that the action of the pressure existing in ducts 6, 20 and 30 tends to keep the assembly in a sealed state.

Above the valve member there is the armature 28 of an electromagnet 22 which is biased by spring 29 into engagement with the vave member 25.

In operation, during normal driving electromagnet 22 is supplied with current and the armature 28 compresses the spring 29, allowing the spring 26 to force valve 25 onto seat 24. The system is sealed and the injection process takes place in the normal manner. When the injection process needs to be stopped, the current supply to electromagnet 22 is interrupted and the armature 28 is forced back by spring 28 and lifts the valve member against the action of spring 26. This is made possible by the fact that a stronger design is used for spring 29 than for spring 26. The system is no longer sealed so that, at the time of the injection, the fuel is discharged through channel 23 and passes to the low pressure side of the feed pump 3.

Depending on the state of the electrical supply to electromagnet 22, it is possible to obtain either a normal injection process or to suppress the injection in its entirety. The usual operation in practice will be to suppress the injection during the deceleration stage of the vehicle. An electrical signal for operating the electromagnet may be provided by a logic system 31 which takes account of the "speed of rotation of the associated engine" and the "accelerator pedal position". The logic system 31 is supplied with a speed signal from the transducer 18C and with a signal representing the position of the control lever 18B by means of a transducer 32.

In FIG. 5A the solid line shows the speed/quantity relationship when the accelerator pedal is in the minimum fuel position that is with the driver's foot removed from the pedal. The dotted line shows the speed/quantity relationship when the pedal is depressed a small amount. As will be seen when the pedal is in the zero fuel position no fuel is delivered to the engine until the engine speed has reached the value No.

FIG. 5B shows in a different way the operation of the pump. The upper graphs shows a sudden release of the accelerator pedal to the minimum fuel position and this causes decelaration of the engine as seen in the centre graph. The lower graph shows at the instant of pedal release, a reduction to zero of the fuel flow to the engine, fuel flow being restored when the engine speed has fallen to the value No after which the regulator controls the fuel flow.

The electrical data obtained may also be used to ascertain the position of a regulating device, with this device being designed to sense the position of the accelerator pedal and the rotating speed of the associated engine.

The electromagnet and valve may be used to stop the engine in which case the valve 19 fitted to known injection pumps is no longer required. In this case, the electrical signal will come from the ignition key of the vehicle.

It is also possible to use the electromagnet and valve to vent the injection pump when the pump is fitted to the associated engine. Following removal and refitting of the pump, it is quite common for the pumping chamber 10 and the associated ducts 6, 7 and 8 to be full of air. This results in an extremely long start-up time, as the air which needs to be evacuated can only be vented slowly. By de-energising the electromagnet 22 when the engine starter is rotating, fuel is allowed to flow through the passages of the pump, thus, purging the air from the pumping chamber.

After a few seconds of operation under these conditions, the electromagnet can be energised to obtain starting of the engine.

The three application possibilities as described above may be used simultaneously within the same injection pump, or in any desired combination.

I claim:

1. A fuel injection pump for supplying fuel to an internal combustion engine, comprising a rotary distributor member mounted in a body part, a bore formed in the distributor member and a plunger in the bore, cam means for imparting inward movement to the plunger as the distributor member is rotated, a plurality of outlets in the body part, a longitudinal passage in the distributor member connected at one end to said bore, a delivery passage communicating with said longitudinal passage and opening onto the periphery of the distributor member for communication with said outlets in turn during successive increased movement of the plunger, an inlet passage connected to said longitudinal passage at a position intermediate said bore and the delivery passage, an inlet port in the body part, regulator means having a control lever and being responsive to engine speed and the setting of said control lever and which controls fuel flow into said bore through the inlet port and inlet passage for retaining residual fuel flow in engine deceleration stage low speed operation and eliminating injected flow at medium and high speeds, a further passage in the distributor member, said further passage being connected with the other end of the longitudinal passage, said further passage permanently communicating with a circumferential groove on the distributor member, and valve means in the body part, said valve means communicating with said circumferential groove, said valve means being arranged to be opened to interrupt the supply of fuel to the associated engine.

2. A fuel injection pump for supplying fuel to an internal combustion engine, comprising a rotary distributor member mounted in a body part, a bore formed in the distributor member and a plunger in the bore, cam means for imparting inward movement to the plunger as the distributor member is rotated, a plurality of outlets in the body part, a longitudinal passage in the distributor member connected at one end to said bore, a delivery passage communicating with said longitudinal passage and opening onto the periphery of the distributor member for communication with said outlets in turn during successive increased movement of the plunger, an inlet passage connected to said longitudinal passage at a position intermediate said bore and the delivery passage, an inlet port in the body part, regulator means responsive to engine speed and the setting of a control lever for controlling fuel flow to said bore through the inlet port and inlet passage, a further passage in the distributor member, said further passage being connected with the other end of the longitudinal passage, said further passage communicating with a circumferential groove on the distributor member, and valve means in the body part, said valve means communicating with said circumferential groove, said valve means being arranged to be opened to interrupt the supply of fuel to the associated engine.

3. A pump according to claim 2 in which said valve means comprises an electromagnetic valve, and a control system for said valve, said control system being responsive to the speed of the associated engine and the setting of said control lever.

4. A pump according to claim 3 in which said valve can be opened to allow venting of air from fuel conveying ducts within the pump.

* * * * *